US005443566A

United States Patent [19]

Rushmer et al.

[11] Patent Number: 5,443,566

[45] Date of Patent: Aug. 22, 1995

[54] ELECTRONIC ANTISWAY CONTROL

[75] Inventors: Michael W. Rushmer; Thomas A. Ruddy; Krzystof Brukalo; Allen M. Ritter, all of Roanoke, Va.

[73] Assignee: General Electric Company, Salem, Va.

[21] Appl. No.: 247,687

[22] Filed: May 23, 1994

[51] Int. Cl.[6] ..... B66C 13/06

[52] U.S. Cl. ..... 212/275

[58] Field of Search ..... 212/137, 153, 147

[56] References Cited

U.S. PATENT DOCUMENTS

| | | | |
|---|---|---|---|
| 3,850,308 | 11/1974 | Meyer et al. | 212/132 |
| 4,135,628 | 1/1979 | Harris et al. . | |
| 4,136,391 | 1/1979 | Eterno et al. . | |
| 4,512,711 | 4/1985 | Ling et al. . | |
| 4,544,070 | 10/1985 | Sickler . | |
| 4,603,783 | 8/1986 | Tax et al. . | |
| 4,717,029 | 1/1988 | Yasunobu et al. . | |
| 4,756,432 | 7/1988 | Kawashima et al. . | |
| 4,883,184 | 11/1989 | Albus . | |
| 4,905,848 | 3/1990 | Skjonberg . | |
| 4,945,294 | 7/1990 | Anderson . | |
| 4,997,095 | 3/1991 | Jones et al. . | |
| 5,117,992 | 6/1992 | Simkus, Jr. et al. . | |
| 5,127,533 | 7/1992 | Virkkunen . | |

FOREIGN PATENT DOCUMENTS

| | | | |
|---|---|---|---|
| 342655 | 11/1989 | European Pat. Off. . | |
| 2022745 | 11/1971 | Germany . | |
| 2414559 | 10/1974 | Germany . | |
| 3228302 | 2/1984 | Germany . | |
| 3335402 | 4/1985 | Germany . | |
| 3513007 | 12/1985 | Germany . | |
| 3714570 | 11/1987 | Germany . | |
| 3722738 | 1/1988 | Germany . | |
| 3710492 | 10/1988 | Germany . | |
| 267018 | 4/1989 | Germany | 212/147 |
| 3933527 | 4/1991 | Germany | 212/147 |
| 52-47254 | 4/1977 | Japan . | |
| 52-61048 | 5/1977 | Japan . | |
| 53-7058 | 1/1978 | Japan . | |
| 53-22250 | 3/1978 | Japan . | |
| 53-111957 | 9/1978 | Japan . | |
| 1-281293 | 11/1989 | Japan . | |
| 1-281294 | 11/1989 | Japan . | |
| 1-313298 | 12/1989 | Japan . | |
| 1-313299 | 12/1989 | Japan . | |
| 2-28493 | 1/1990 | Japan . | |
| 2-75506 | 3/1990 | Japan . | |
| 2-86595 | 3/1990 | Japan . | |
| 2-132099 | 5/1990 | Japan . | |
| 1342866 | 10/1897 | U.S.S.R. . | |
| 502830 | 4/1976 | U.S.S.R. . | |
| 1018899 | 5/1983 | U.S.S.R. . | |
| 1047102 | 3/1985 | U.S.S.R. . | |
| 1053443 | 5/1985 | U.S.S.R. . | |
| 1261888 | 7/1986 | U.S.S.R. . | |
| 1364598 | 1/1988 | U.S.S.R. . | |
| 1379238 | 3/1988 | U.S.S.R. . | |
| 1527134 | 12/1989 | U.S.S.R. . | |
| 1562296 | 5/1990 | U.S.S.R. . | |
| 1564102 | 5/1990 | U.S.S.R. . | |
| 8602341 | 4/1986 | WIPO . | |

*Primary Examiner*—F. J. Bartuska
*Assistant Examiner*—Thomas J. Brahan
*Attorney, Agent, or Firm*—Nixon & Vanderhye

[57] ABSTRACT

The invention is for the electronic control of the sway of a suspended load from a crane. The natural frequency $\omega_n$ of a simple pendulum is used to estimate the velocity and displacement of the suspended load, and a signal representative of measured load displacement is used to drive the estimated load displacement to the measured load displacement and modify the estimated velocity.

15 Claims, 5 Drawing Sheets

ELECTRONIC ANTISWAY CONTROL

FIELD OF THE INVENTION

The invention is in the field of sway control of suspended loads on a crane.

BACKGROUND

Loads suspended from a trolley on a crane are subject to swaying during trolley movement, sudden changes caused by improper operator control of the system, wind or collision with an object. Methods are known to control the sway of a suspended load on cranes so that when the load is brought to a halt, there is little or no sway. Several prior art methods exist for achieving this result. In mechanical or hydro-mechanical systems increased natural damping has been used to minimize load sway at all times. While this technique has been generally successful, it is accompanied by both high initial cost and maintenance costs. Another prior art approach is to use a predetermined speed reference profile which has been simulated or recorded and is used to produce minimum sway. For automatic moves where the starting and final positions of the load are known in advance, this approach works well. However, there is no ability to reduce sway caused by random motion of the trolley induced by improper operator control. Yet another prior art approach has been to use a load sway regulator. This involves the use of an external sensor to provide feedback of some load movement parameter such as angle or acceleration. While this approach is suitable for reducing or eliminating sway induced by random trolley motion, it requires a special sensing device and dedicated processing capacity.

BRIEF DESCRIPTION OF THE INVENTION

A digital adjustable speed drive for the trolley is provided with an antisway control feature. The trolley speed regulator is augmented with a load velocity estimator for modifying the speed command signal to the trolley. In this way, closed loop regulation of the load speed is accomplished, and without the use of special sensors to detect aspects of load motion such as position, speed, acceleration or angle. In addition, load sway is controlled for random trolley motion, due to improper operator inputs, and external disturbances, such as wind and collisions.

DISCLOSURE OF THE INVENTION

The invention is based upon the determination that the equation of motion for a simple pendulum can be used in estimating the velocity of the suspended load. This determination was made through an analysis of the suspended load system using Lagrange's equation of motion. Estimated load velocity and an estimated load displacement are determined and then modified through the comparison of the estimated load displacement with a parameter representing measured load displacement.

Figure 1:
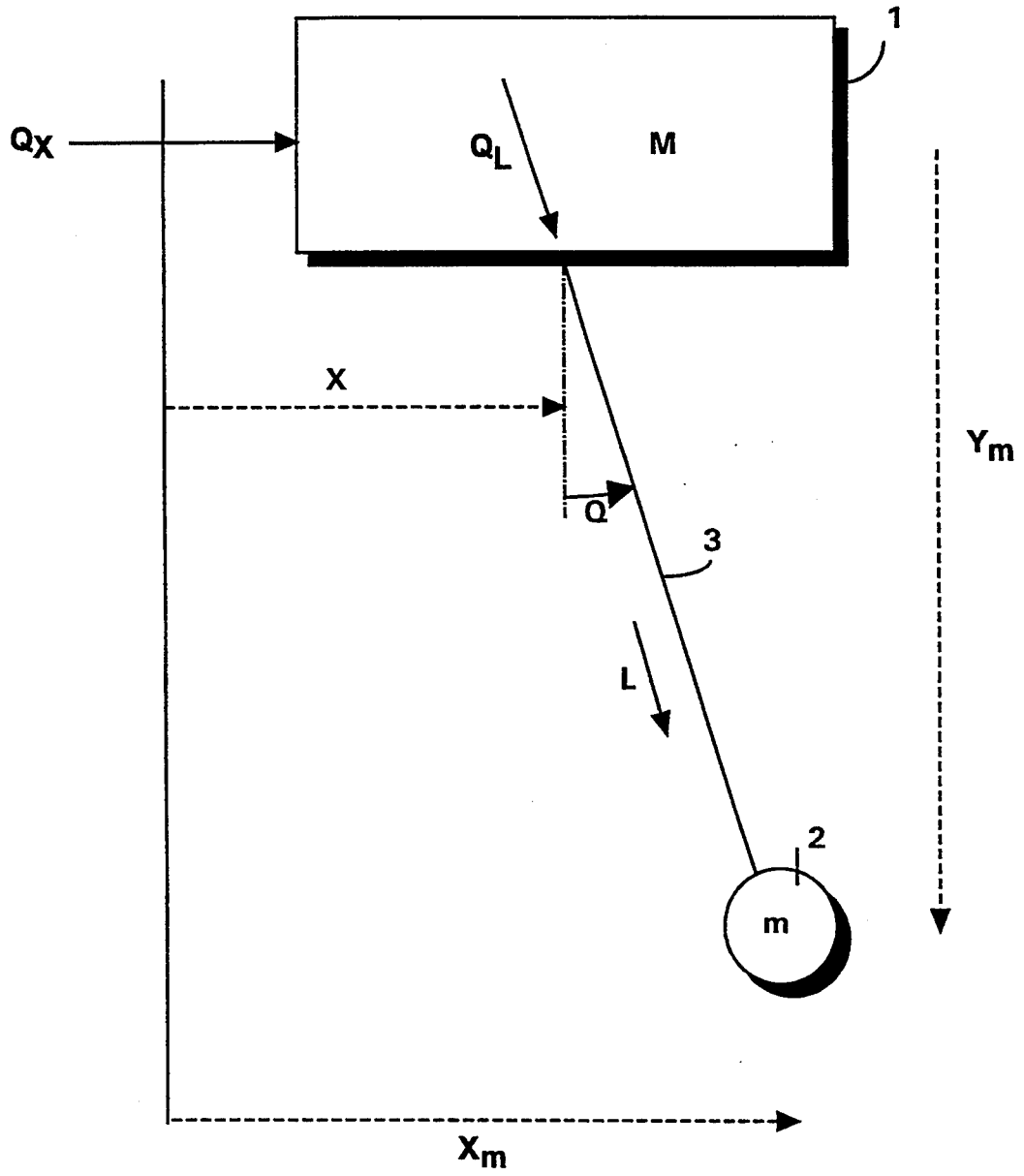
FIG. 1 is a simplified diagram of a suspended load system.

In the simplified diagram of the suspended load system of FIG. 1, block 1 represents the trolley having an effective mass M, 2 represents the suspended load having a mass m and 3 is the hoist cable. $Q_x$ is the force applied by the trolley motor in the x direction and $Q_L$ is the force applied by the hoist motor in the L direction. There are three degrees of freedom in the system: x represents movement in the x direction, $\theta$ represents the angular displacement from the vertical by which the suspended load may follow the trolley and L represents the length of the hoist cable.

Lagrange's equation for an oscillating non-conservative system is used to derive the three equations of motion for the system and is defined as follows.

$$\frac{d}{dt}\left(\frac{\partial T}{\partial \dot{q}_i}\right)-\frac{\partial T}{\partial q_i}=-\frac{\partial V}{\partial q_i}-\frac{\partial F}{\partial \dot{q}_i}+Q_i$$

where $q_i$ is the coordinate being considered.

The left hand side of the equation contains the inertial terms and the right hand side contains the generalized forces. The inertial terms are expressed as a function of the kinetic energy T. The first term on the right hand side is derived from the potential energy of the system V, the second term from the retarding forces due to viscous friction while the third term $Q_i$ includes all other forces applied to the system. For undamped, frictionless motion as assumed here, the second term $-\delta F/\delta \dot{q}_i$ can be ignored.

The total kinetic energy of the system T is the sum of the kinetic energy of the two masses M and m. T is thus expressed as follows.

$$T=\tfrac{1}{2}M\,\dot{x}^2+\tfrac{1}{2}\,m(\dot{x}_m{}^2+\dot{y}_m{}^2)$$

The system potential energy V is simply the gravitational potential energy of the mass m and is expressed as below.

$$V=m\,g\,y_m$$

From the diagram of FIG. 1, it can be seen that $x_m$, and $y_m$ are coordinates expressed as $$x_m=x+L\sin\theta \text{ and}$$

$$y_m=-L\cos\theta.$$

Substituting these expressions for $x_m$ and $y_m$ into the equations for T and V and solving Lagrange's equation produces three equations of motion.

$$Q_x=(M+m)\ddot{x}+mL(\ddot{\theta}\cos\theta-\dot{\theta}^2\sin\theta)+m\ddot{L}\sin\theta+2m\dot{L}\dot{\theta}\cos\theta$$

$$O=m\ddot{x}L\cos\theta+mL^2\ddot{\theta}+mgL\sin\theta+2mL\dot{L}\dot{\theta}$$

$$Q_L=m\ddot{L}\times m\ddot{x}\sin\theta\text{-}mL\dot{\theta}^2\text{-}mg\cos\theta$$

These three equations show there are terms affecting trolley acceleration $\ddot{x}$ and the load angular acceleration $\ddot{\theta}$ that are a function of the movement of the hoist. The equation for $Q_L$, which describes the hoist movement, is affected by load angular speed $\dot{\theta}$ and trolley acceleration $\ddot{x}$. These are coupling terms that are determined by considering the relative magnitudes of terms based on representative values of L, $\dot{L}$, $\ddot{L}$, $\dot{x}$, $\ddot{x}$, $\theta$, $\dot{\theta}$, and $\ddot{\theta}$. Table 1 lists representative values for a large quay container crane.

TABLE I

| QTY | TYPICAL VALUE | UNITS |
|---|---|---|
| $\dot{x}$ | 3.0 | meters/sec |
| $\ddot{x}$ | 0.5 | meters/sec$^2$ |
| L | 6 to 30 | meters |
| $\dot{L}$ | 2.0 | meters/sec |
| $\ddot{L}$ | 1.0 | meters/sec$^2$ |
| $\theta$max | 0.1 (est.) | radians |
| $\dot{\theta}$max | 0.004 (est.) | radians/sec |
| $\ddot{\theta}$max | 0.1 (est.) | radians/sec$^2$ |

The values in the table suggest that the equation for hoist motion $Q_L$ can be closely approximated by $$Q_L = m\ddot{L} - mg\cos\theta$$

This equation suggests that the hoist motion is decoupled from the trolley. This is evident since the L and $\theta$ coordinates are orthogonal and the L and x coordinates are almost orthogonal. These equations can thus be approximated by $$Q_x = (M+m)\ddot{x} + L\ddot{\theta}\cos\theta \text{ and}$$

$$O = m\ddot{x}L\cos\theta + mL^2\ddot{\theta} + mgL\sin\theta$$

The last two equations indicate that the coupling between the x and $\theta$ coordinates cannot be ignored. This is correct since the x and $\theta$ coordinates are close to being coincident for small values of $\theta$. Solving this pair of simultaneous equations for $\ddot{x}$ and $\ddot{\theta}$, and by the use of small angle approximations for sine and $\cos\theta$ these equations can be reduced to $$\ddot{x} = Q_x + mg\theta/M \text{ and}$$

$$L\ddot{\theta} = -(M+m)g\theta - Q_x/M$$

These equations represent approximations of the equations of motion from Lagrange's equation. Moreover, by considering the case where the trolley is moving at a constant speed and the load is disturbed then the previously derived equation $$O = m\ddot{x}L\cos\theta + mL^2\ddot{\theta} + mgL\sin\theta$$

is used alone. With $\ddot{x}$ being zero under these circumstances, then this equation reduces to $$\ddot{\theta} = (-g/L)\theta$$

which is the equation of motion for a simple pendulum.

Figure 2:
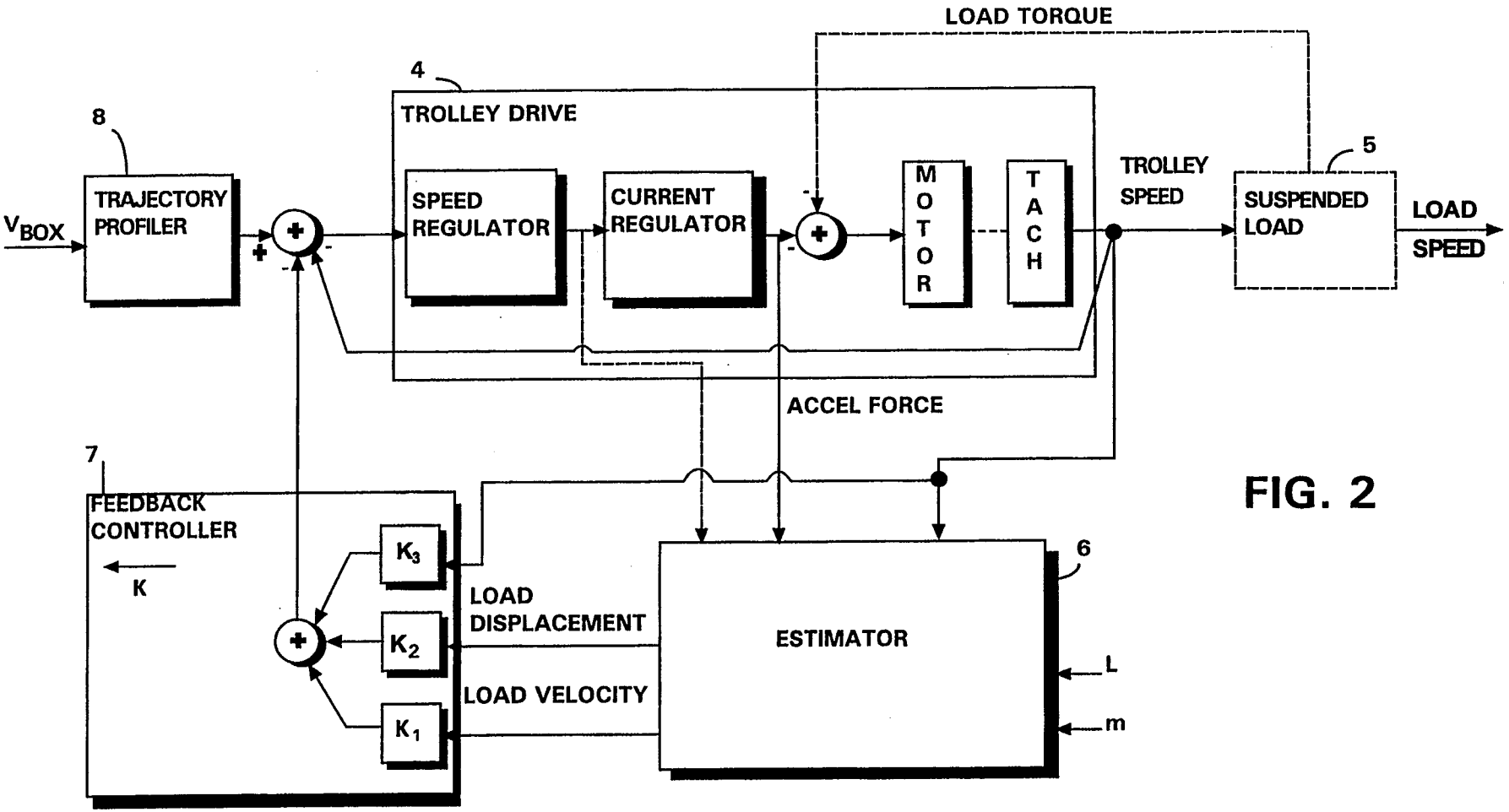
FIG. 2 is a generalized representation of the system.

FIG. 2 is a general representation of the system illustrating a trolley drive unit 4, a block 5 representing the suspended load, an estimator 6 and a feedback controller 7. A speed command signal is input to the trolley drive unit 4. The trajectory profiler 8, in response to an operator input $V_{BOX}$, provides a control signal which is summed with the output of the feedback controller 7 to generate the speed command signal. The trolley drive unit 4 as illustrated comprises a speed regulator, a current regulator, a summing point, a motor and a tach. The trolley speed $\dot{x}$ output from the tach is provided as an input to the suspended load block 5, the estimator 6 and the feedback controller 7. The load torque fed back from the suspended load is implied. An accelerating force signal is derived from the current regulator, at either the input or the output, and is provided as an input to the estimator 6. The estimator 6 provides as outputs an estimated load velocity signal and an estimated displacement signal based on the equation of motion for a simple pendulum. These signals together with the trolley speed feedback signal are combined in the feedback controller 7 to generate the signal that is summed with the input control signal and the trolley speed feedback signal to provide the speed command signal.

Either the current input to the current regulator or the current output from the current regulator is monitored to provide a signal representing the accelerating force. This signal, which is proportional to the torque of the motor, is provided as a measured input parameter to the estimator 6 where it is used for correcting the estimated load velocity and estimated displacement. It is a high resolution signal in which sway of the load of one to two inches can be resolved. The gain factors K1, K2 and K3 of the feedback controller 7, as one skilled in the art will appreciate, are linear gains calculated to give the desired closed loop system response.

The trolley drive unit employs speed regulation, which allows the trolley acceleration $\ddot{x}$ to be a calculable quantity. In addition, the accelerating force $Q_x$ is a known internal quantity of the trolley speed regulator. Since data pertaining to the effective mass of the trolley and the load are available, this allows the equation $$\ddot{x} = Q_x + mb\theta/M$$

to be used to solve for load displacement ($\theta$). The difference between the angle measured or derived from the accelerating force signal and the estimated angle is used with proportional gain to drive the estimated angle towards the measured value and thus correct the estimate. This is further evident from a consideration of FIG. 3.

Figure 3:
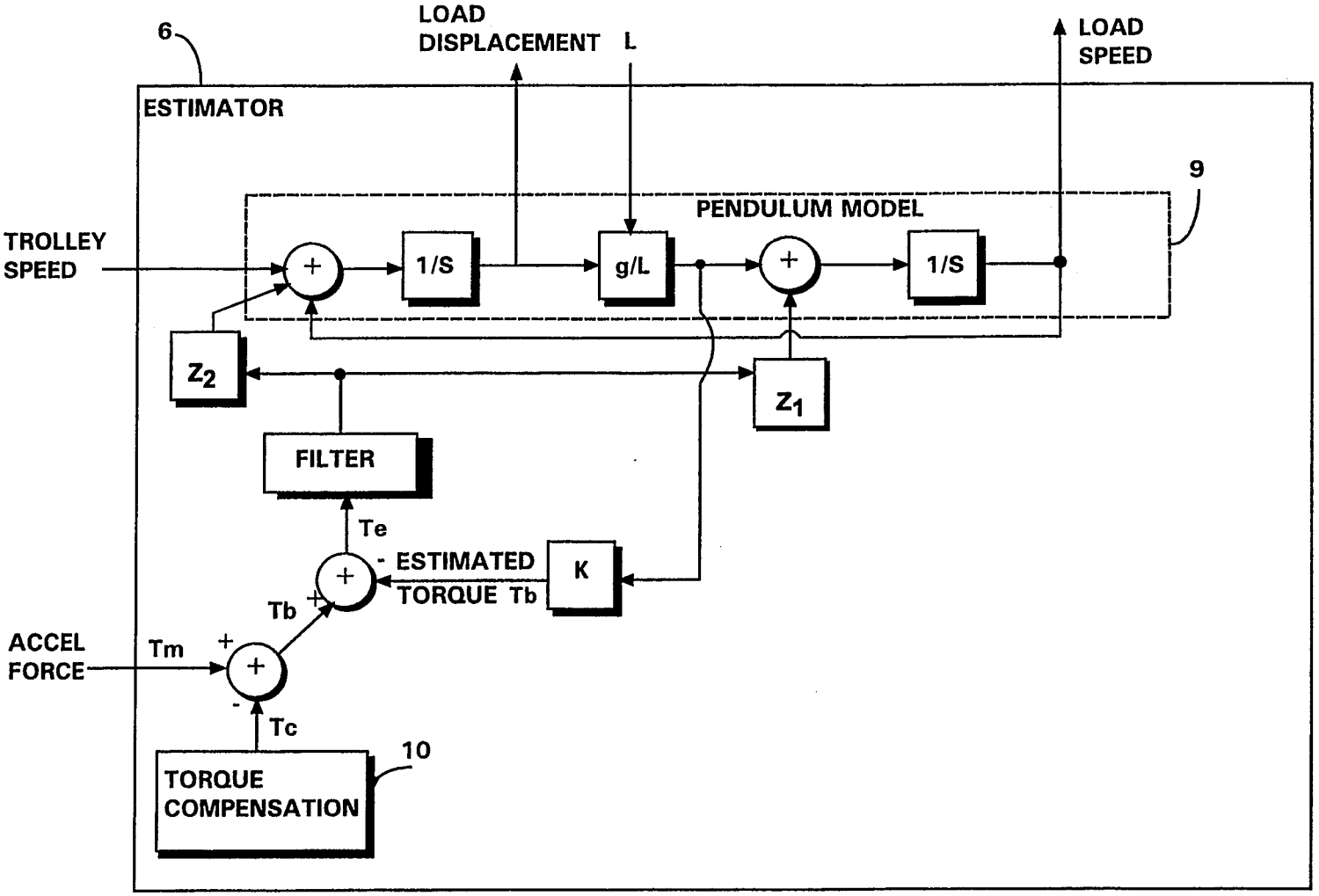
FIG. 3 is a detailed representation of the estimator.

In FIG. 3, a block labeled 9 is a model of the pendulum. The element g/L has as an input parameter L, the cable hoist length. The output side of the g/L element is estimated acceleration, which upon integration in the element 1/s provides the estimated load velocity output. In the closed loop model, the estimated load velocity is fed back and subtracted from the trolley speed to produce a $\Delta V$ which is integrated to produce a signal ($x$-$x_m$) at the input side of the g/L element, which is the estimated load displacement.

Coupled to the pendulum model are elements for driving the estimated values of displacement and velocity to values derived from the measured parameter. The measured parameter, which is the acceleration force signal picked off the motor current regulator and is proportional to the torque of the motor, has subtracted from it at a first summing point the torque compensation for the drive from element 10 to produce a signal Tb which represents the measured torque of the load. This measured value for the torque of the load is then subtracted from the estimated torque $\hat{T}b$ at a second summing point. A signal Te, the torque error signal, is thereby produced. The torque error signal is filtered in a band pass filter to remove noise from the low signal to noise signal output from the current regulator. The band pass is selected to correspond to the nominal frequency of oscillation of the pendulum, $\omega_n$. This is generally in the range of 0.5 to 2 radians/second. Linear gain units Z1 and Z2 provide the filtered error signal to the summing points of the pendulum model 9. The estimated torque signal is the estimated acceleration signal multiplied by a K gain factor which factor is determined as a function of the linear speed, mass and length of the load. Examples of the torque compensation for the drive, block 10, are illustrated in FIGS. 4A and B.

Figure 4B:
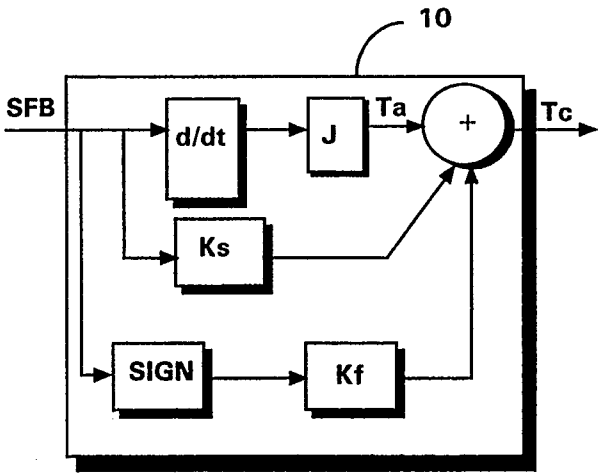
FIGS. 4A and 4B are diagrams illustrating the components of torque compensation.
Figure 4A:
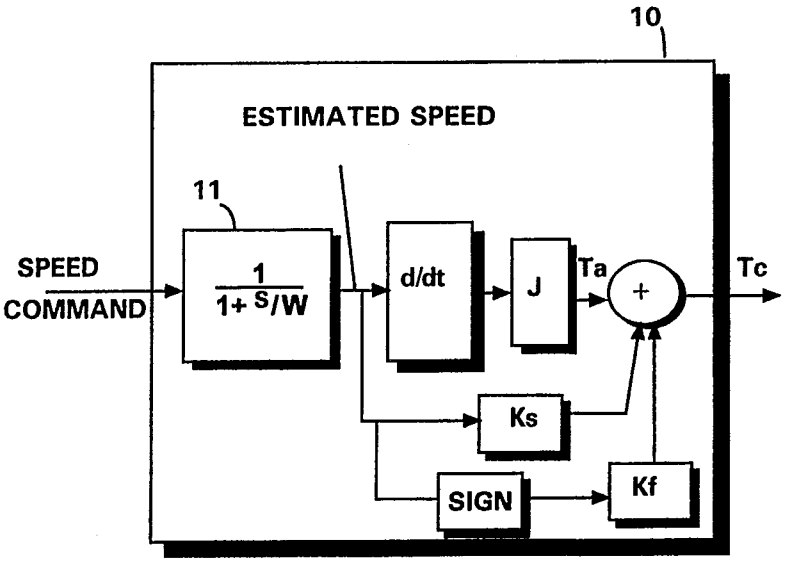

FIGS. 4A and B, illustrate the torque compensations in the drive. They are generally designated as J, the fixed inertia, Ks, the windage losses, and Kf, the friction. In each embodiment, the three factors are summed to form a signal Tc representative of the combined parameters. In FIG. 4A, the element 11 provides a characteristic $$\frac{1}{1 + s/\omega}$$

for the elements illustrated in trolley drive 4, where $\omega$ is the speed regulator response. FIG. 4B illustrates the use of the speed feedback signal.

Figure 5:
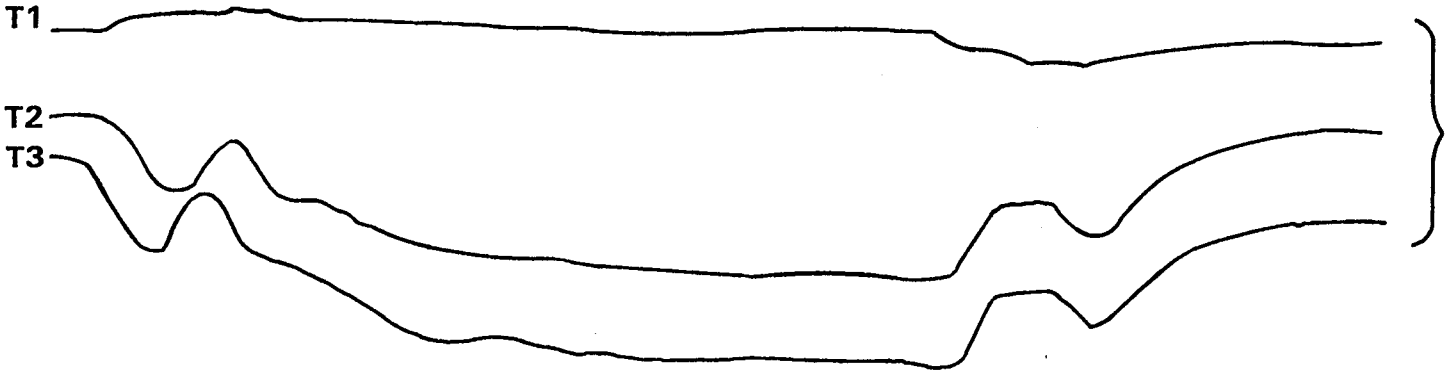
FIG. 5 is a chart of test results.
Figure 6:
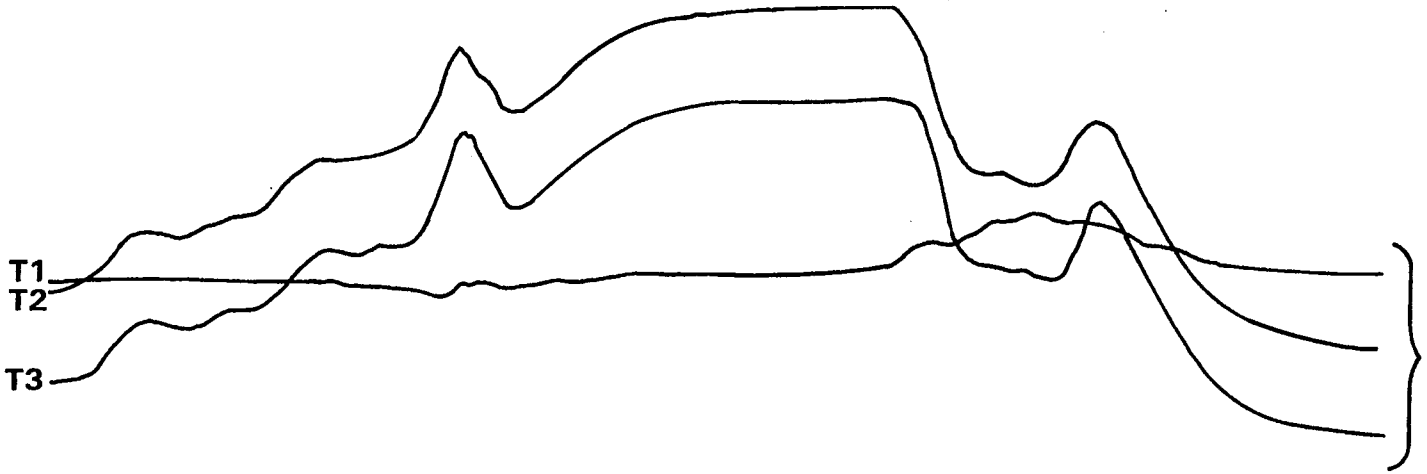
FIG. 6 is a chart of test results using a varying cable length.

FIG. 5 is a chart of an actual test run using a cable length L of 51.1 feet. Trace T1 is the output of an angle sensor coupled to the cable suspending the load. Trace T2 is the trolley motor speed, and T3 the drive speed command. FIG. 6 is a chart of an actual test run where the cable length was reduced from 92 feet to 34 feet at the rate of 175 feet/min. The traces T1-T3 represent the same measurements as above. The traces of FIGS. 5 and 6 were obtained using a DC 2000 adjustable speed drive.

Sway control is simply and effectively achieved completely internally of an adjustable speed drive. Stated otherwise, there is no addition of computing power to the drive nor is there an external measuring device used in implementing sway control of the load.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of controlling the sway of a suspended load traveling at a speed $\dot{x}$ in the x direction comprising: estimating the speed of the load in the x direction, measuring the accelerating force produced by a speed regulator driving the suspended load in the x direction, correcting the load speed estimate as a function of the measured accelerating force produced by the speed regulator driving the suspended load in the x direction, continuously modifying the speed of the load in the x direction in response to the corrected load speed estimate so as to reduce the sway of the load.

wherein the estimating of the speed of the load is based on an equation of motion for a simple pendulum, and wherein an estimated load displacement in the x direction is derived and is modified in accordance with a derived load displacement which is proportional to the measured accelerating force, whereby the estimated load displacement is driven to converge with the derived load displacement.

2. A method as in claim 1 wherein said estimated load displacement is used in estimating the load speed.

3. A method as in claim 1 wherein a model of a pendulum is employed in estimating the load speed and load displacement.

4. A method as in claim 1 wherein the control is accomplished completely internally of an adjustable speed drive.

5. A method of controlling the sway of a suspended load traveling at a speed $\dot{x}$ in the x direction comprising: estimating the speed of the load in the x direction, measuring the accelerating force produced by a speed regulator driving the suspended load in the x direction, correcting the load speed estimate as a function of the measured accelerating force produced by the speed regulator driving the suspended load in the x direction, continuously modifying the speed of the load in the x direction in response to the corrected load speed estimate so as to reduce the sway of the load, wherein the estimating of the speed of the load is based on an equation of motion for a simple pendulum, and wherein an estimated load speed is derived and is modified in accordance with a measured load speed which is proportional to the measured accelerating force, whereby the estimated load speed is driven to the measured load speed.

6. Apparatus comprising.

a trolley, a load suspended from said trolley, a speed regulator for driving and controlling the speed of said trolley, a controller for modifying an input speed control signal to said speed regulator, an estimator in circuit with said controller for providing inputs to said controller, said estimator being responsive to a measured torque signal produced by the speed regulator for providing as inputs to said controller signals that are an estimate of the horizontal displacement of said suspended load with respect to the trolley and an estimate of the velocity of said suspended load, and a speed feedback signal from said trolley coupled to the input of said estimator and said controller.

7. Apparatus in accordance with claim 6 wherein said estimator includes a pendulum model circuit which generates from a length of suspension of the load and the speed feedback signal, said estimated load displacement and said estimated load velocity signals for input to said controller, and an estimated torque signal which is compared with the measured torque signal to generate a correction input to the pendulum model circuit for the estimated load displacement and estimated load velocity signals whereby said estimated load displacement and said estimated load velocity signals are driven to values representative of measured values.

8. Apparatus in accordance with claim 7 wherein a filter is provided for filtering the correction input.

9. Apparatus in accordance with claim 8 wherein said trolley includes a current regulator means for providing a high resolution measured torque signal therefrom to said estimator.

10. Apparatus in accordance with claim 9 wherein said pendulum model circuit includes means for providing an estimate of the load torque, said estimator includes means for generating a compensating torque, means for subtracting said compensating torque from said high resolution measured torque signal to produce a compensated measured load torque, means for subtracting said compensated measured load torque from said estimate of the load torque to produce an error torque signal, means for filtering said error torque signal, means for summing the filtered error signal with said estimate of the load torque, and means for summing said filtered error signal with said estimated load velocity and trolley speed feedback signal.

11. Apparatus in accordance with claim 10 wherein said speed regulator, controller and estimator are disposed entirely within an adjustable speed trolley drive.

12. Apparatus in accordance with claim 11 wherein said means for generating a compensating torque comprises circuit means for modeling the speed response of said trolley drive, providing a speed command signal thereto, means for differentiating the output thereof to provide a torque signal representative of the inertial torque of the trolley drive, means for factoring the output thereof to provide a torque representative of windage losses, means to provide a torque representative of friction and means for combining the inertial torque, the windage losses torque and the friction torque.

13. Apparatus controlling the sway of a load suspended from a trolley with means disposed entirely within an adjustable speed drive comprising means for continuously estimating the load displacement, load velocity and load torque, a current regulator means for providing current proportional to a measured torque signal, means for subtracting a compensating torque and said estimated load torque from said measured torque signal to produce an error signal, means for feeding back said error signal to correct said estimated load displacement and said estimated load velocity, whereby said estimated load displacement and said estimated load velocity are driven to respective values determined by the measured torque signal.

14. Apparatus for controlling the sway of a suspended load as in claim 13 further comprising means for filtering said error signal.

15. Apparatus for controlling the sway of a suspended load as in claim 14 wherein said current regulator means for providing a measured torque signal includes means for picking off a high resolution signal from said current regulator, and said means for providing a compensating torque includes, means with response characteristics corresponding to that of said drive for generating a speed feedback signal from a speed command signal, means for differentiating said speed feedback signal and generating a signal representative of the inertial torque of the drive, means for generating a signal representative of the windage losses, means for generating a signal representative of friction and means for combining the representative signals.

* * * * *